US012535253B2

(12) United States Patent
Sakthivel et al.

(10) Patent No.: US 12,535,253 B2
(45) Date of Patent: Jan. 27, 2026

(54) REFRIGERATION SYSTEM WITH EXPANDER-ASSISTED COOLING AND METHODS OF USE

(71) Applicant: Heatcraft Refrigeration Products LLC, Stone Mountain, GA (US)

(72) Inventors: Saravana Vaithilingam Sakthivel, Oxford, MS (US); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 280 days.

(21) Appl. No.: 18/500,272

(22) Filed: Nov. 2, 2023

(65) Prior Publication Data

US 2025/0146725 A1 May 8, 2025

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01)

(58) Field of Classification Search
CPC ..... F25B 49/02; F25B 13/00; F25B 11/04; F25B 41/20; F25B 41/22; F25B 41/39; F25B 5/02; F25B 6/04; F25B 2400/075; F25B 1/10; F25B 9/008; F25B 2309/061; F25B 2400/13; F25B 2400/14; F25B 2400/23
See application file for complete search history.

(56) References Cited

U.S. PATENT DOCUMENTS

2019/0353414 A1* 11/2019 Karbiner ..... F25B 11/02

FOREIGN PATENT DOCUMENTS

WO WO-2020025770 A2 * 2/2020 ..... F25B 11/02

* cited by examiner

*Primary Examiner* — Emmanuel E Duke
(74) *Attorney, Agent, or Firm* — Baker Botts L.L.P.

(57) ABSTRACT

A method of operating a refrigeration system is disclosed. The method comprises cooling a refrigerant using a first high side heat exchanger, and reducing the pressure of a first portion of the refrigerant received from the first high side heat exchanger using a first expansion valve in a first low side heat exchanger unit. The method further comprises cooling a first space with the refrigerant received from the first expansion valve using a first low side heat exchanger in the first low side heat exchanger unit, and reducing the pressure of a second portion of the refrigerant received from the high side heat exchange using an expander of an expansion-compression unit. The method further comprises compressing the refrigerant received from the first low side heat exchanger using a compressor of the expansion-compression unit.

20 Claims, 2 Drawing Sheets

REFRIGERATION SYSTEM WITH EXPANDER-ASSISTED COOLING AND METHODS OF USE

TECHNICAL FIELD

This disclosure relates generally to refrigeration systems. More particularly, in certain embodiments, this disclosure relates to a refrigeration system with expander-assisted cooling and methods of use.

BACKGROUND

Refrigeration systems are used to regulate environmental conditions within an enclosed space. Refrigeration systems are used for a variety of applications, such as in supermarkets and warehouses, to cool stored items. For example, refrigeration systems may provide cooling operations for refrigerators and freezers.

SUMMARY

The systems and methods in the present disclosure provide practical applications and technical advantages that overcome the current technical problems described herein. Various expansion processes in refrigeration systems, such as the expansion of high pressure gas in an expansion valve positioned between a gas cooler and a flash tank in the system, result in wasted energy that is not recovered to perform useful work. The provided systems and methods are integrated into the practical application of using an expansion-compression unit (e.g., an expander) to recover a portion of energy from the expansion process which can be utilized to compress refrigerant to satisfy the cooling load for an additional suction group in the system (e.g., a heating, ventilation, and cooling system). The provided systems and methods provide an improvement to the underlying technology by recovering energy that would otherwise be wasted to perform useful work to cool a load within the system.

In some embodiments, the present disclosure provides a refrigeration system. The refrigeration system comprises a high side heat exchanger configured to receive a refrigerant and cool the received refrigerant. The refrigeration system comprises a first low side heat exchanger unit positioned downstream of the first high side heat exchanger, where the first low side heat exchanger unit comprises a first expansion valve positioned upstream of a first low side heat exchanger. The first expansion valve is configured to receive a first portion of the refrigerant from the first high side heat exchanger and reduce the pressure of the received refrigerant. The first low side heat exchanger is configured to cool a first space proximate to the first low side heat exchanger The refrigeration system comprises an expansion-compression unit positioned downstream of the first high side heat exchanger. The expansion-compression unit comprises an expander configured to receive a second portion of the refrigerant from the high side heat exchanger, where the expander is configured to reduce the pressure of the second portion of the refrigerant. The expansion-compression unit comprises a compressor configured to compress the refrigerant received from the low side heat exchanger unit.

Certain embodiments of this disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
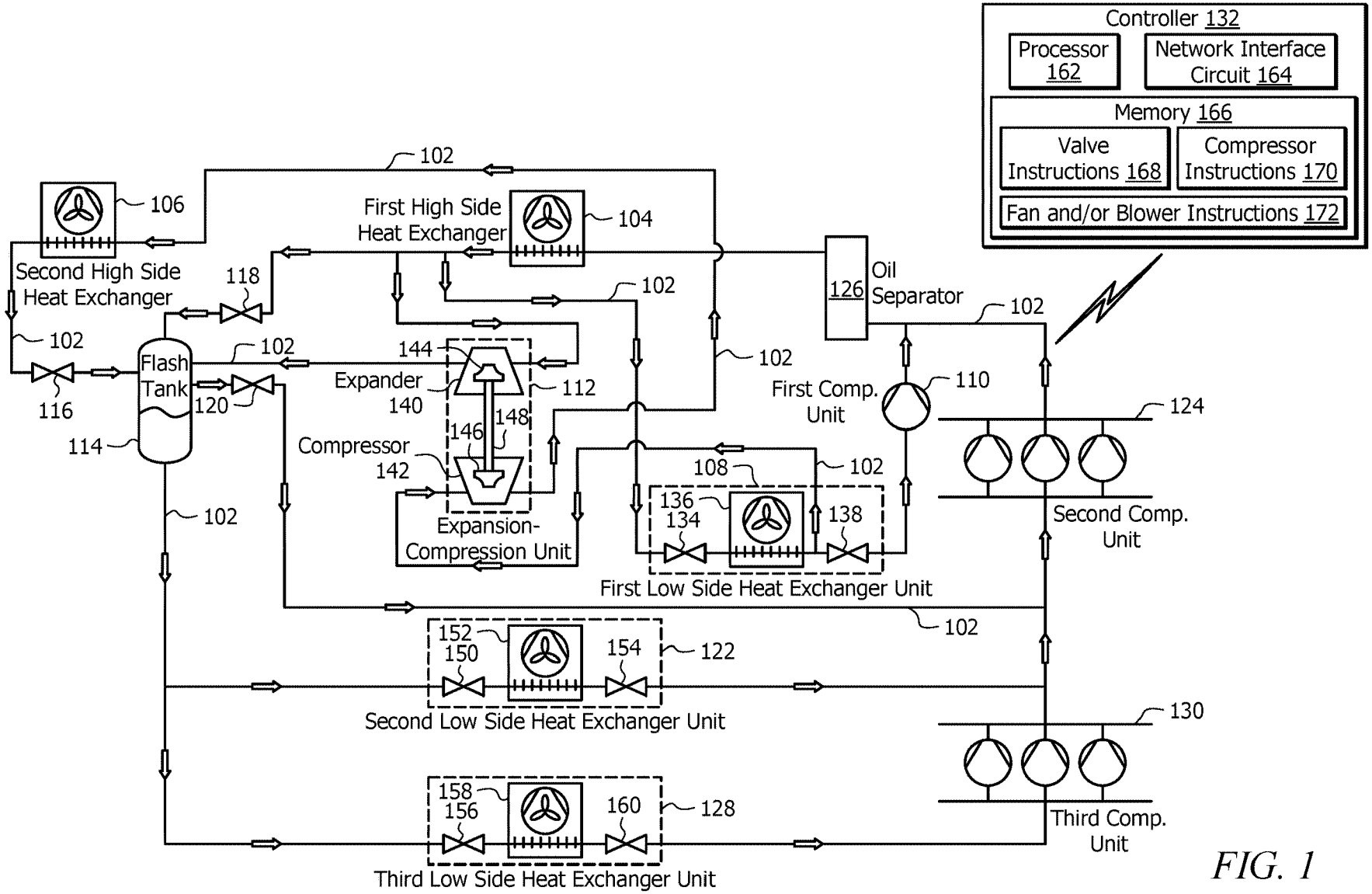
FIG. 1 illustrates a block diagram illustrating an example refrigeration system according to an embodiment of the present disclosure.
Figure 2:
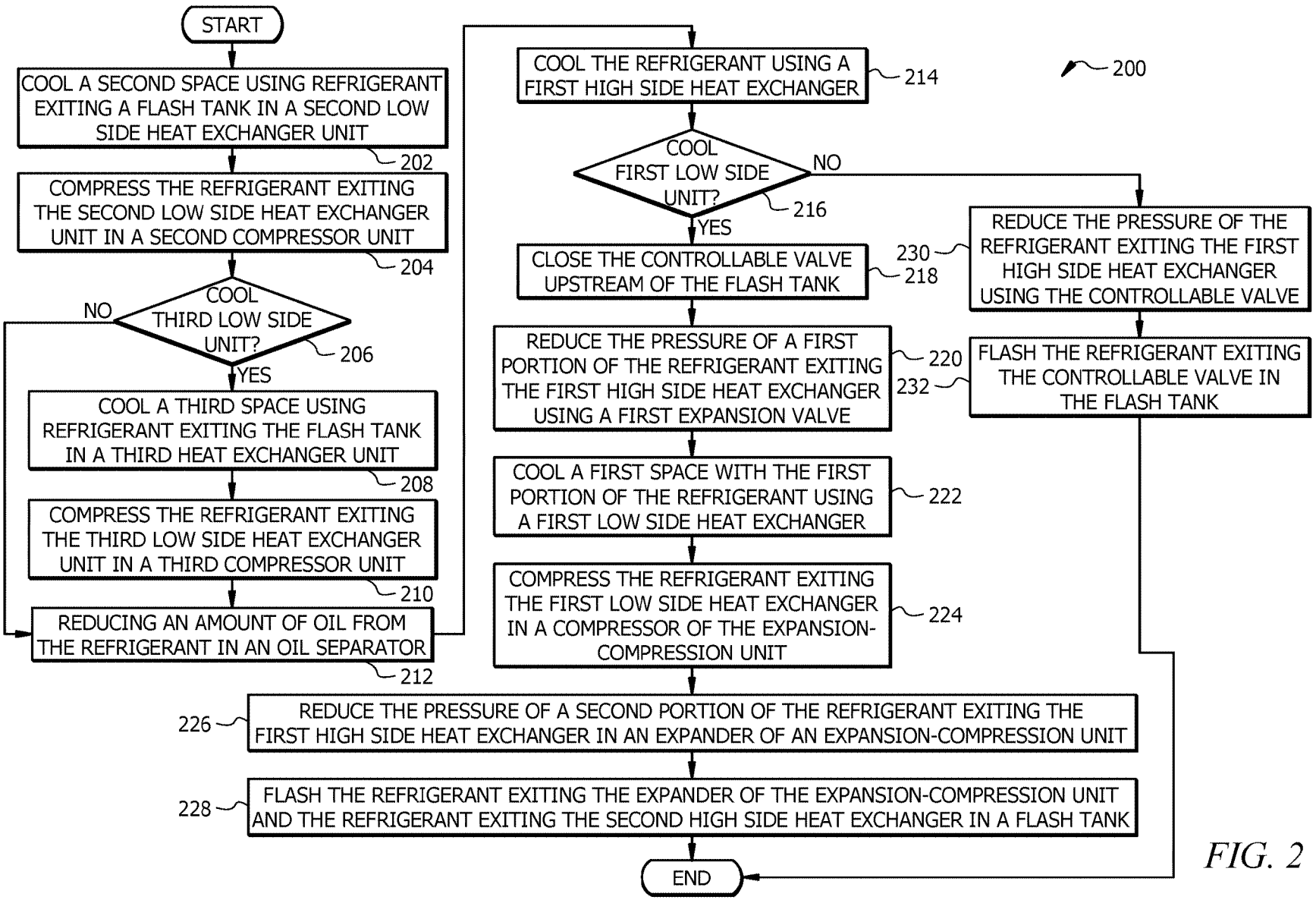
FIG. 2 illustrates a flowchart of one embodiment of a method of operating the system of FIG. 1.

Embodiments of the present disclosure and its advantages are best understood by referring to FIGS. 1-2 of the drawings, like numerals being used for like and corresponding parts of the various drawings.

As described above, various expansion processes in refrigeration systems, such as the expansion of high pressure gas in an expansion valve positioned between a gas cooler and a flash tank in the system, result in wasted energy that is not recovered to perform useful work. The provided systems and methods are integrated into the practical application of using an expansion-compression unit (e.g., an expander) to recover a portion of energy from the expansion process which can be utilized to compress refrigerant to satisfy the cooling load for an additional suction group in the system (e.g., a heating, ventilation, and cooling system). The provided systems and methods provide an improvement to the underlying technology by recovering energy that would otherwise be wasted to perform useful work to cool a load within the system.

System Overview

FIG. 1 illustrates an example refrigeration system 100 according to various embodiments of the present disclosure. In general, the refrigeration system 100 includes a refrigerant conduit subsystem 102, a first high side heat exchanger 104, a second high side heat exchanger 106, a first low side heat exchanger unit 108, a first compressor unit 110, an expansion-compression unit 112, a flash tank 114, a valve 116, a controllable valve 118, a flash gas valve 120, a second low side heat exchanger unit 122, a second compressor unit 124, an oil separator 126, a third low side heat exchanger unit 128, and a third compressor unit 130, and a controller 132. In some embodiments, the refrigeration system 100 is a transcritical refrigeration system that circulates a transcritical refrigerant such as $CO_2$.

System Components

Refrigerant conduit subsystem 102 facilitates the movement of refrigerant (e.g., $CO_2$) through a refrigeration cycle such that the refrigerant flows as illustrated by arrows in FIG. 1. The refrigerant conduit subsystem 102 includes any conduit, tubing and the like that is illustrated in FIG. 1 fluidly connecting components of the refrigeration system 100.

The first high side heat exchanger 104 is fluidly coupled to the refrigerant conduit subsystem 102. The first high side heat exchanger 104 is positioned downstream from the first compressor unit 110 and the second compressor unit 124, and is configured to receive refrigerant from the first compressor unit 110 and the second compressor unit 124. The first high side heat exchanger 104 is configured to apply a cooling stage to the received refrigerant. In some embodiments, the first high side heat exchanger 104 is a gas cooler or a condenser. The first high side heat exchanger 104 may comprise cooling coils configured to circulate the received refrigerant, where air is forced across an external surface of the cooling coils. In certain configurations, heat is removed from the refrigerant and transferred to the air surrounding the cooling coils. The first high side heat exchanger 104 may be positioned on a rooftop so that heat removed from the refrigerant may be discharged into the air. In some embodiments, the first high side heat exchanger 104 comprises a fan that transports the air across the outer surface of the coils. The fan may be in communication with the controller 132 (e.g., via wired and/or wireless communication) to receive control signals for turning the fan on, off, and for controlling the speed of the fan to regulate the flow of air across the coils.

The controllable valve 118 is configured to receive refrigerant from the first high side heat exchanger 104 and is fluidly coupled to the refrigerant conduit subsystem 102. The controllable valve 118 may be an expansion valve, a flow control valve (e.g., a thermostatic expansion valve), or any suitable valve that is configured to reduce the pressure of the refrigerant in the refrigerant conduit subsystem 102. The controllable valve 118 may transition the refrigeration system 100 from operating in a normal mode of operation to an energy savings mode of operation. In the normal mode of operation, the controllable valve 118 may be in an open position to direct the flow of refrigerant received from the first high side heat exchanger 104 to the flash tank 114. In the energy savings mode of operation, the controllable valve 118 may be in a closed position to direct a first portion of the refrigerant from the first high side heat exchanger 104 to the first low side heat exchanger unit 108, and a second portion of the refrigerant from the first high side heat exchanger 104 to the expansion-compression unit 112. The controllable valve 118 may be in communication with controller 132 (e.g., via wired or wireless communication) to receive control signals for opening, closing, and/or to provide flow measurement signals corresponding to flow rate of refrigerant through the controllable valve 118.

The first low side heat exchanger unit 108 is positioned downstream of the first high side heat exchanger 104, and is generally configured to receive a first portion of the refrigerant from the first high side heat exchanger 104 via the refrigerant conduit subsystem 102. In some embodiments, the first low side heat exchanger unit 108 is a heating, ventilation, and air conditioning (HVAC) unit configured to cool a first space proximate the first low side heat exchanger unit 108. In some embodiments, the first low side heat exchanger unit 108 comprises a first expansion valve 134 positioned upstream of a first low side heat exchanger 136 and a valve 138 positioned downstream of the first low side heat exchanger 136. The first expansion valve 134 is fluidly coupled to the refrigerant conduit subsystem 102 and configured to reduce the pressure of the refrigerant. The first expansion valve 134 may be a flow control valve (e.g., a thermostatic expansion valve valve) or any other suitable valve for reducing pressure from the working fluid while, optionally, providing control of the rate of flow of the refrigerant. The valve 138 may be configured to regulate the flow rate of the refrigerant exiting the first low side heat exchanger 136. For example, when the valve 138 is in a closed position, the refrigerant exiting the first low side heat exchanger 136 is directed to a compressor 142 of the expansion-compression unit 112. When the valve 138 is in an open position, the refrigerant exiting the first low side heat exchanger 136 is directed to the first compressor unit 110. The first expansion valve 134 and the valve 138 may be in communication with the controller 132 (e.g., via wired and/or wireless communication) to receive control signals for opening and/or closing associated valves and/or provide flow measurement signals corresponding to the rate of refrigerant through the refrigerant conduit subsystem 102.

The first low side heat exchanger 136 is fluidly coupled to the refrigerant conduit subsystem 102 and configured to receive refrigerant from the first expansion valve 134. The first low side heat exchanger 136 is generally any heat exchanger configured to provide heat transfer between the refrigerant flowing through the refrigerant conduit subsystem 102 and airflow passing across an external surface of the first low side heat exchanger 136. The first low side heat exchanger 136 may include one or more circuits of coils configured to circulate the received refrigerant through the first low side heat exchanger 136. The first low side heat exchanger 136 may act as an evaporator to transfer heat between the airflow passing across the external surface of the coils and the refrigerant to produce conditioned airflow. The conditioned airflow may then be transferred to the first space proximate the first low side heat exchanger unit 108 to cool the first space. The first low side heat exchanger unit 108 may include a blower to transport airflow across the external surface of the coils. The blower may be in communication with the controller 132 (e.g., vi wired and/or wireless communication) to receive control signals for turning the blower on, off and for controlling the speed of the blower to regulate the flow of air across the coils.

The first compressor unit 110 is fluidly coupled to the refrigerant conduit subsystem 102. The first compressor unit 110 includes one or more compressors that is configured to compress (i.e., increase the pressure) of the refrigerant. In some embodiments, the first compressor unit 110 is positioned downstream of the first low side heat exchanger unit 108. A first portion of refrigerant exiting the first low side heat exchanger unit 108 may be directed to the compressor 142 of the expansion-compression unit 112, and a second portion of the refrigerant exiting the first low side heat exchanger unit 108 may be directed to the first compressor unit 110. The one or more compressors of the first compressor unit 110 is in signal communication with the controller 132 using wired and/or wireless connection. The controller 132 provides commands and/or signals to control operation of the one or more compressors of the first compressor unit 110. For example, the controller 132 may provide signals to instruct the one or more compressor(s) to operate at a predetermined compressor speed. The one or more compressor(s) of the first compressor unit 110 may vary by design and/or capacity. For example, some compressor designs may be more energy efficient than other compressor designs, and the one or more compressor(s) of the first compressor unit 110 may have modular capacity (e.g., a capability to vary capacity).

The oil separator 126 is fluidly coupled to the refrigerant conduit subsystem 102 and may be located downstream of the first compressor unit 110, the second compressor unit 124, and the third compressor unit 130. The oil separator 126 is operable to separate compressor oil from the refrigerant. The refrigerant exiting the oil separator 126 is provided to the first high side heat exchanger 104, while the oil may be collected and returned to the first compressor unit 110, the second compressor unit 124, and the third compressor unit 130, as appropriate.

The expansion-compression unit 112 is fluidly coupled to the refrigerant conduit subsystem 102. The expansion-compression unit 112 is positioned downstream of the first high side heat exchanger 104 and downstream of the first low side heat exchanger unit 108. The expansion-compression unit 112 comprises an expander 140 configured to receive a second portion of the refrigerant from the first high side heat exchanger 104, and a compressor 142 configured to receive refrigerant from the first low side heat exchanger unit 108. The expander 140 is configured to reduce the pressure of the second portion of the refrigerant received from the first high side heat exchanger 104, and the compressor 142 is configured to compress the refrigerant received from the first low side heat exchanger unit 108. In some embodiments, the expander 140 comprises an expander wheel 144 that is coupled to a compressor wheel 146 via a shaft 148. In some embodiments, the expander wheel 144 comprises turbine blades configured to reduce the pressure of the received refrigerant, and the compressor wheel 146 comprises turbine blades configured to compress the received refrigerant. Receiving the second portion of the refrigerant from the first high side heat exchanger 104 causes the expander wheel 144 to rotate and reduce the pressure of the second portion of the refrigerant received from the first high side heat exchanger 104 in the expander 140. The rotation of the expander wheel 144 causes the compressor wheel 146 to rotate via the shaft 148, and in turn the compressor 142 compresses the refrigerant received from the first low side heat exchanger unit 108. In this way, the expansion-compression unit 112 may recover a portion of energy that would have otherwise been lost in the controllable valve 118 during a normal mode of operation, and may use this energy to facilitate operation of the first low side heat exchanger unit 108.

The second high side heat exchanger 106 is fluidly coupled to the refrigerant conduit subsystem 102. The second high side heat exchanger 106 is positioned downstream from the expansion-compression unit 112, and is configured to receive refrigerant from the compressor 142 of the expansion-compression unit 112 via the refrigerant conduit subsystem 102. The second high side heat exchanger 106 is configured to apply a cooling stage to the received refrigerant. In some embodiments, the second high side heat exchanger 106 is a gas cooler or a condenser. The second high side heat exchanger 106 may comprise cooling coils configured to circulate the received refrigerant, where air is forced across an external surface of the cooling coils. In certain configurations, heat is removed from the refrigerant and transferred to the air surrounding the cooling coils. The second high side heat exchanger 106 may be positioned on a rooftop so that heat removed from the refrigerant may be discharged into the air. In some embodiments, the second high side heat exchanger 106 comprises a fan that transports the air across the outer surface of the coils. The fan may be in communication with the controller 132 (e.g., via wired and/or wireless communication) to receive control signals for turning the fan on, off, and for controlling the speed of the fan to regulate the flow of air across the coils.

The valve 116 is configured to receive refrigerant from the second high side heat exchanger 106 and is fluidly coupled to the refrigerant conduit subsystem 102. The valve 116 may be an expansion valve, a flow control valve (e.g., a thermostatic expansion valve), or any suitable valve that is configured to reduce the pressure of the refrigerant in the refrigerant conduit subsystem 102. The valve 116 may be in communication with controller 132 (e.g., via wired or wireless communication) to receive control signals for opening, closing, and/or to provide flow measurement signals corresponding to flow rate of refrigerant through the valve 116.

The flash tank 114 is fluidly coupled to the refrigerant conduit subsystem 102 and is positioned downstream of the first high side heat exchanger 104, the second high side heat exchanger 106, and the expansion-compression unit 112. During a normal mode of operation, the flash tank 114 is configured to receive refrigerant from the first high side heat exchanger 104 and the controllable valve 118. During the energy savings mode of operation, the flash tank 114 is configured to receive refrigerant from the expander 140 and refrigerant from the second high side heat exchanger 106. The flash tank 114 is configured to separate the refrigerant into a vapor refrigerant and a liquid refrigerant. Typically, the vapor refrigerant collects near the top of the flash tank 114 and the liquid refrigerant is collected at the bottom of the flash tank 114. In some embodiments, the liquid refrigerant flows from flash tank 114 and provides cooling to the second low side heat exchanger unit 122 and the third low side heat exchanger unit 128. A flash gas valve 120 may be positioned in the refrigerant conduit subsystem 102 and located in a portion of the refrigerant conduit subsystem 102 that connects the flash tank 114 to the second compressor unit 124. The flash gas valve 120 is configured to open and close to permit or restrict the flow of flash gas discharged from flash tank 114. The controller 132 is in communication with the flash gas valve 120 and controls its operation.

The second low side heat exchanger unit 122 is fluidly coupled to the refrigerant conduit subsystem 102 and is located downstream of the flash tank 114. The second low side heat exchanger unit 122 is configured to receive liquid refrigerant from the flash tank 114 through the refrigerant conduit subsystem 102. The second low side heat exchanger unit 122 is configured to use the refrigerant to provide cooling to a second space proximate to the second low side heat exchanger unit 122. As an example the second low side heat exchanger unit 122 may be part of a refrigerated case and/or cooler for storing items that should be kept at particular temperatures. The refrigeration system 100 may include any appropriate number of second low side heat exchanger units 122 with the same or a similar configuration to that shown for the example the second low side heat exchanger unit 122 in FIG. 1.

In some embodiments, the second low side heat exchanger unit 122 comprises a second expansion valve 150 positioned upstream of a second low side heat exchanger 152 and a valve 154 positioned downstream of the second low side heat exchanger 152. The second expansion valve 150 is fluidly coupled to the refrigerant conduit subsystem 102 and configured to reduce the pressure of the refrigerant. The second expansion valve 150 may be a flow control valve (e.g., a thermostatic expansion valve valve) or any other suitable valve for reducing pressure from the working fluid while, optionally, providing control of the rate of flow of the refrigerant. The valve 154 may be configured to regulate the flow rate of the refrigerant exiting the second low side heat exchanger 152. The second expansion valve 150 and the valve 154 may be in communication with the controller 132 (e.g., via wired and/or wireless communication) to receive control signals for opening and/or closing associated valves and/or provide flow measurement signals corresponding to the rate of refrigerant through the refrigerant conduit subsystem 102.

The second low side heat exchanger 152 is fluidly coupled to the refrigerant conduit subsystem 102 and configured to receive refrigerant from the second expansion valve 150. The second low side heat exchanger 152 is generally any heat exchanger configured to provide heat transfer between the refrigerant flowing through the refrigerant conduit subsystem 102 and airflow passing across an external surface of the second low side heat exchanger 152. The second low side heat exchanger 152 may include one or more circuits of coils configured to circulate the received refrigerant through the second low side heat exchanger 152. The second low side heat exchanger 152 may act as an evaporator to transfer heat between the airflow passing across the external surface of the coils and the refrigerant to produce conditioned airflow. The conditioned airflow may then be transferred to the second space proximate the second low side heat exchanger unit 122 to cool the second space. The second low side heat exchanger unit 122 may include a fan to transport airflow across the external surface of the coils. The fan may be in communication with the controller 132 (e.g., via wired and/or wireless communication) to receive control signals for turning the fan on, off and for controlling the speed of the fan to regulate the flow of air across the coils. In some embodiments, the second expansion valve 150 is configured to achieve a refrigerant temperature into the second low side heat exchanger 152 at a predefined temperature for a given application (e.g., about −6° C.). Refrigerant exiting the second low side heat exchanger unit 122 is returned to the second compressor unit 124 through the refrigerant conduit subsystem 102.

The second compressor unit 124 is fluidly coupled to the refrigerant conduit subsystem 102. The second compressor unit 124 includes one or more compressors that is configured to compress (i.e., increase the pressure) of the refrigerant. In some embodiments, the second compressor unit 124 is positioned downstream of the second low side heat exchanger unit 122, the third low side heat exchanger unit 128, and the third compressor unit 130. The one or more compressors of the second compressor unit 124 is in signal communication with the controller 132 using wired and/or wireless connection. The controller 132 provides commands and/or signals to control operation of the one or more compressors of the second compressor unit 124. For example, the controller 132 may provide signals to instruct the one or more compressor(s) to operate at a predetermined compressor speed. The one or more compressor(s) of the second compressor unit 124 may vary by design and/or capacity. For example, some compressor designs may be more energy efficient than other compressor designs, and the one or more compressor(s) of the second compressor unit 124 may have modular capacity (e.g., a capability to vary capacity).

The third low side heat exchanger unit 128 is generally similar to the second low side heat exchanger unit 122 but configured to operate at lower temperatures (e.g., for deep freezing applications near about −30° C. or the like). The third low side heat exchanger unit 128 is fluidly coupled to the refrigerant conduit subsystem 102 and is located downstream of the flash tank 114. The third low side heat exchanger unit 128 is configured to receive liquid refrigerant from the flash tank 114 through the refrigerant conduit subsystem 102. The third low side heat exchanger unit 128 is configured to use the refrigerant to provide cooling to a third space proximate to the third low side heat exchanger unit 128. As an example the third low side heat exchanger unit 128 may be part of a refrigerated case and/or cooler for storing items that should be kept at particular temperatures. The refrigeration system 100 may include any appropriate number of third low side heat exchanger units 128 with the same or a similar configuration to that shown for the example the third low side heat exchanger unit 128 in FIG. 1.

In some embodiments, the third low side heat exchanger unit 128 comprises a third expansion valve 156 positioned upstream of a third low side heat exchanger 158 and a valve 160 positioned downstream of the third low side heat exchanger 158. The third expansion valve 156 is fluidly coupled to the refrigerant conduit subsystem 102 and configured to reduce the pressure of the refrigerant. The third expansion valve 156 may be a flow control valve (e.g., a thermostatic expansion valve valve) or any other suitable valve for reducing pressure from the working fluid while, optionally, providing control of the rate of flow of the refrigerant. The valve 160 may be configured to regulate the flow rate of the refrigerant exiting the third low side heat exchanger 158. The third expansion valve 156 and the valve 160 may be in communication with the controller 132 (e.g., via wired and/or wireless communication) to receive control signals for opening and/or closing associated valves and/or provide flow measurement signals corresponding to the rate of refrigerant through the refrigerant conduit subsystem 102.

The third low side heat exchanger 158 is fluidly coupled to the refrigerant conduit subsystem 102 and configured to receive refrigerant from the third expansion valve 156. The third low side heat exchanger 158 is generally any heat exchanger configured to provide heat transfer between the refrigerant flowing through the refrigerant conduit subsystem 102 and airflow passing across an external surface of the third low side heat exchanger 158. The third low side heat exchanger 158 may include one or more circuits of coils configured to circulate the received refrigerant through the third low side heat exchanger 158. The third low side heat exchanger 158 may act as an evaporator to transfer heat between the airflow passing across the external surface of the coils and the refrigerant to produce conditioned airflow. The conditioned airflow may then be transferred to the third space proximate the third low side heat exchanger unit 128 to cool the third space. The third low side heat exchanger unit 128 may include a fan to transport airflow across the external surface of the coils. The fan may be in communication with the controller 132 (e.g., via wired and/or wireless communication) to receive control signals for turning the fan on, off and for controlling the speed of the fan to regulate the flow of air across the coils. In some embodiments, the third expansion valve 156 is configured to achieve a refrigerant temperature into the third low side heat exchanger 158 at a predefined temperature for a given application (e.g., about −30° C.). Refrigerant exiting the third low side heat exchanger unit 128 is returned to the third compressor unit 130 through the refrigerant conduit subsystem 102.

The third compressor unit 130 is fluidly coupled to the refrigerant conduit subsystem 102. The third compressor unit 130 includes one or more compressors that is configured to compress (i.e., increase the pressure) of the refrigerant. In some embodiments, the third compressor unit 130 is positioned downstream of the third low side heat exchanger unit 128. The one or more compressors of the third compressor unit 130 is in signal communication with the controller 132 using wired and/or wireless connection. The controller 132 provides commands and/or signals to control operation of the one or more compressors of the third compressor unit 130. For example, the controller 132 may provide signals to instruct the one or more compressor(s) to operate at a predetermined compressor speed. The one or more compressor(s) of the third compressor unit 130 may vary by design and/or capacity. For example, some compressor designs may be more energy efficient than other compressor designs, and the one or more compressor(s) of the third compressor unit 130 may have modular capacity (e.g., a capability to vary capacity).

The controller 132 is in communication with various components in the system including but not limited to, valves 116, 118, 120, 134, 138, 150, 154, 156, 160, compressors of the first compressor unit 110, the second compressor unit 124, the third compressor unit 130*s*, fans and/or blowers of the first high side heat exchanger 104, the second high side heat exchanger 106, the first low side heat exchanger unit 108, the second low side heat exchanger unit 122, and the third low side heat exchanger unit 128. The controller 132 adjusts operation of components of the refrigeration system 100 to operate in a normal mode of operation and an energy savings mode of operation, as described herein.

The controller 132 includes a processor 162, a network interface circuit 164, and a memory 166. The processor 162 includes one or more processors operably coupled to the memory 166. The processor 162 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 166 and controls the operation of refrigeration system 100. The processor 162 may be a programmable logic device, a microcontroller, a microprocessor, or any suitable combination of the preceding. The processor 162 is communicatively coupled to and in signal communication with the memory 166. The one or more processors are configured to process data and may be implemented in hardware or software. For example, the processor 162 may be 8-bit, 16-bit, 32-bit, 64-bit or of any other suitable architecture. The processor 162 may include an arithmetic logic unit (ALU) for performing arithmetic and logic operations, processor registers that supply operands to the ALU and store the results of ALU operations, and a control unit that fetches instructions from memory 166 and executes them by directing the coordinated operations of the ALU, registers, and other components. The processor 162 may include other hardware and software that operates to process information, control the refrigeration system 100, and perform any of the functions described herein (e.g., with respect to FIGS. 1-2). The processor 162 is not limited to a single processing device and may encompass multiple processing devices. Similarly, the controller 132 is not limited to a single controller but may encompass multiple controllers.

The network interface circuit 164 is configured to communicate data and signals with other devices. For example, the network interface circuit 164 may be configured to communicate electrical signals with the components of the refrigeration system 100. The network interface circuit 164 may be configured to communicate with other devices and systems. The network interface circuit 164 may provide and/or receive, for example, compressor speed signals, compressor on/off signals, valve open/close signals, temperature signals, pressure signals, temperature setpoints, environmental conditions, and an operating mode status for the refrigeration system 100 and send electrical signals to the components of the refrigeration system 100. The network interface circuit 164 may include ports or terminals for establishing signal communications between the controller 132 and other devices. The network interface circuit 164 may be configured to enable wired and/or wireless communications. Suitable network interface circuits 164 include a WIFI interface, a local area network (LAN) interface, a wide area network (WAN) interface, a modem, a switch, or a router. The network interface circuit 164 may be configured to use any suitable type of communication protocol as would be appreciated by one of ordinary skill in the art.

The memory 166 includes one or more disks, tape drives, or solid-state drives, and may be used as an over-flow data storage device, to store programs when such programs are selected for execution, and to store valve instructions 168, compressor instructions 170, and fan and/or blower operating instructions 172 and data that are read during program execution. The memory 166 may be volatile or non-volatile and may include ROM, RAM, ternary content-addressable memory (TCAM), dynamic random-access memory (DRAM), and static random-access memory (SRAM). The memory 166 is operable (or configured) to store information used by the controller 132 and/or any other logic and/or instructions for performing the function described in this disclosure.

Method of Operation

FIG. 2 illustrates an example operational flow 200 for operating the refrigeration system 100 of FIG. 1. The operational flow 200 can be logically described in two parts. The first part includes operations 202-214, which generally includes cooling a second space proximate the second low side heat exchanger unit 122 using refrigerant exiting the flash tank 114, compressing the refrigerant exiting the second low side heat exchanger unit 122 in a second compressor unit 124, and determining whether a cooling demand exists for the third low side heat exchanger unit 128. If a cooling demand exists, the first part further includes cooling a third space proximate the third low side heat exchanger unit 128 using refrigerant exiting the flash tank 114 and compressing the refrigerant exiting the third low side heat exchanger unit 128 in a third compressor unit 130. If no cooling demand exists for the third low side heat exchanger unit 128, the first part may skip operations 208-210 and proceed to operations 212-214 of the first part, which includes removing oil from the refrigerant in an oil separator and cooling the refrigerant exiting the oil separator in a first high side heat exchanger 104.

The second part includes operations 216-232, which generally includes determining whether a cooling demand exists for the first low side heat exchanger unit 108. If a cooling demand exists, the second part includes closing the controllable valve 118 upstream of the flash tank 114, reducing the pressure of a first portion of the refrigerant exiting the first high side heat exchanger 104 using a first expansion valve 134, cooling a first space with the first portion of the refrigerant exiting the first expansion valve 134 in a first low side heat exchanger 136, and compressing the refrigerant exiting the first low side heat exchanger unit 108 in a compressor 142 of the expansion-compression unit 112 and optionally a first compressor unit 110. The second part further includes reducing the pressure of a second portion of the refrigerant exiting the first high side heat exchanger 104 in an expander 140 of the expansion-compression unit 112, flashing the refrigerant exiting the expander 140 of the expansion-compression unit 112 in the flash tank 114, and flashing the refrigerant exiting the second high side heat exchanger 106 in the flash tank 114. If no cooling demand for the first low side heat exchanger unit 108 exists, the second part includes reducing the pressure of the refrigerant exiting the first high side heat exchanger 104 using the controllable valve 118 and flashing the refrigerant exiting the controllable valve 118 in the flash tank 114.

In operation, the operational flow 200 may begin at operation 202, which includes cooling a second space proximate the second low side heat exchanger unit 122. For example, operation 202 may include cooling the second space with refrigerant exiting the flash tank 114 using the second low side heat exchanger unit 122. To cool the second space, operation 202 may include reducing the pressure of the received refrigerant from the flash tank 114 using a second expansion valve 150 and cooling the second space by passing the refrigerant received from the second expansion valve 150 through the second low side heat exchanger 152. In some embodiments, the second expansion valve 150 is configured to achieve a refrigerant temperature in the second low side heat exchanger 152 at a predefined temperature for a given medium-temperature (MT) application (e.g., about −6° C.). The operational flow 200 continues to operation 204, which includes compressing the refrigerant exiting the second low side heat exchanger unit 122 using the second compressor unit 124.

At decision block 206, the operational flow 200 includes determining whether a cooling demand exists for the third low side heat exchanger unit 128. If a cooling demand exists, the operational flow 200 proceeds to operation 208, which includes cooling a third space proximate the third low side heat exchanger unit 128. For example, operation 202 may include cooling the third space with refrigerant exiting the flash tank 114 using the third low side heat exchanger unit 128. To cool the third space, operation 208 may include reducing the pressure of the received refrigerant from the flash tank 114 using a third expansion valve 156 and cooling the third space by passing the refrigerant received from the third expansion valve 156 through the third low side heat exchanger 158. In some embodiments, the third expansion valve 156 is configured to achieve a refrigerant temperature in the third low side heat exchanger 158 at a predefined temperature for a given low temperature (LT) application (e.g., about −30° C.). The operational flow 200 continues to operation 210, which includes compressing the refrigerant exiting the third low side heat exchanger unit 128 using the third compressor unit 130. If it is determined in decision block 206 that no cooling demand exists for the third low side heat exchanger unit 128, then operational flow 200 may skip operations 208-210 and proceed to operation 212.

At operation 212, the operational flow 200 includes reducing an amount of compressor oil from the refrigerant using the oil separator 126. The refrigerant exiting the oil separator 126 may be provided to the first high side heat exchanger 104, and the oil separated from the refrigerant may be returned to any one of the compressors in the first compressor unit 110, the second compressor unit 124, and/or the third compressor unit 130. At operation 214, the operational flow 200 includes cooling the refrigerant exiting the oil separator 126 in the first high side heat exchanger 104. For example, the first high side heat exchanger 104 is configured to circulate the received refrigerant through cooling coils where air is forced by a fan across an external surface of the cooling coils to provide cooling.

At decision block 216, the operational flow 200 includes determining whether a cooling demand exists for the first low side heat exchanger unit 108. In this way, the operational flow 200 may decide whether to operate in the normal mode (e.g., no cooling demand exists for the first low side heat exchanger unit 108) and an energy saving mode (e.g., a cooling mode exists for the first low side heat exchanger unit 108). If a cooling demand exists, the operational flow 200 continues to operation 218, which includes closing the controllable valve 118 positioned upstream of the flash tank 114 to direct a first portion of the refrigerant from the first high side heat exchanger 104 to a first expansion valve 134 of the first low side heat exchanger unit 108, and to direct a second portion of the refrigerant from the first high side heat exchanger 104 to an expander 140 of the expansion-compression unit 112.

At operation 220, the operational flow 200 includes reducing the pressure of the first portion of the refrigerant exiting the first high side heat exchanger 104 in the first expansion valve 134 of the first low side heat exchanger unit 108. At operation 222, the operational flow includes cooling a first space proximate the first low side heat exchanger 136 using the first portion of refrigerant received from the first expansion valve 134. The first low side heat exchanger 136 may include one or more circuits of coils configured to circulate the received refrigerant through the first low side heat exchanger 136. The first low side heat exchanger 136 may act as an evaporator to transfer heat between the airflow passing across the external surface of the coils and the refrigerant to produce conditioned airflow. The conditioned airflow may then be transferred to the first space proximate the first low side heat exchanger unit 108 to cool the first space. The first low side heat exchanger 136 may include one or more circuits of coils configured to circulate the received refrigerant through the first low side heat exchanger 136. The first low side heat exchanger 136 may act as an evaporator to transfer heat between the airflow passing across the external surface of the coils and the refrigerant to produce conditioned airflow. The conditioned airflow may then be transferred by the blower to the first space proximate the first low side heat exchanger unit 108 to cool the first space. In some embodiments, the first low side heat exchanger unit 108 is a heating, ventilation, and air conditioning (HVAC) unit configured to cool a first space proximate the first low side heat exchanger unit 108.

At operation 224, the operational flow 200 includes compressing the refrigerant exiting the first low side heat exchanger unit 108 in a compressor 142 of the expansion-compression unit 112. At operation 226, the operational flow 200 includes reducing the pressure of the second portion of the refrigerant exiting the first high side heat exchanger in the expander 140 of the expansion-compression unit 112. In some embodiments, the expander 140 comprises an expander wheel 144 that is coupled to a compressor wheel 146 via a shaft 148. In some embodiments, the expander wheel 144 comprises turbine blades configured to reduce the pressure of the received refrigerant, and the compressor wheel 146 comprises turbine blades configured to compress the received refrigerant. Receiving the second portion of the refrigerant from the first high side heat exchanger 104 causes the expander wheel 144 to rotate and reduce the pressure of the second portion of the refrigerant received from the first high side heat exchanger 104 in the expander 140. The rotation of the expander wheel 144 causes the compressor wheel 146 to rotate via the shaft 148, and in turn the compressor 142 compresses the refrigerant received from the first low side heat exchanger unit 108. In this way, the expansion-compression unit 112 may recover a portion of energy that would have otherwise been lost in the controllable valve 118 during a normal mode of operation, and may use this energy to facilitate operation of the first low side heat exchanger unit 108.

At operation 228, the operational flow 200 includes flashing the refrigerant exiting the expander 140 of the expansion-compression unit 112 and the refrigerant exiting the second high side heat exchanger 106 in the flash tank 114. In some embodiments prior to receiving the refrigerant from the second high side heat exchanger 106, operation 228 includes reducing the pressure of the refrigerant exiting the second high side heat exchanger 106 in a valve 116. The flash tank 114 is configured to separate the refrigerant into a vapor refrigerant and a liquid refrigerant. Typically, the vapor refrigerant collects near the top of the flash tank 114 and the liquid refrigerant is collected at the bottom of the flash tank 114. In some embodiments, the liquid refrigerant flows from flash tank 114 and provides cooling to the second low side heat exchanger unit 122 and the third low side heat exchanger unit 128. Once operation 228 is complete, the operational flow 200 may end or may be repeated by re-starting operation 202.

Returning to decision block 216, if it is determined that no cooling demand exists for the first low side heat exchanger unit 108, the operational flow 200 continues to operation 230, which includes reducing the pressure of the refrigerant exiting the first high side heat exchanger 104 using the controllable valve 118. At operation 232, the operational flow 200 includes flashing the refrigerant exiting the controllable valve in the flash tank 114. Once operation 228 is complete, the operational flow 200 may end or may be repeated by re-starting operation 202.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112 (f) as it exists on the date of filing hereof unless the words "means for" or "step for" are explicitly used in the particular claim.

The invention claimed is:

1. A refrigeration system, comprising:

a first high side heat exchanger configured to receive refrigerant, the first high side heat exchanger configured to cool the refrigerant;

a first low side heat exchanger unit positioned downstream of the first high side heat exchanger, the first low side heat exchanger unit comprising a first expansion valve positioned upstream of a first low side heat exchanger, wherein the first expansion valve is configured to receive a first portion of the refrigerant from the first high side heat exchanger, and wherein the first low side heat exchanger is configured to cool a first space proximate to the first low side heat exchanger; and an expansion-compression unit positioned downstream of the first high side heat exchanger and the first low side heat exchanger unit, the expansion-compression unit comprising:

an expander configured to receive a second portion of the refrigerant from the first high side heat exchanger, wherein the expander is configured to reduce a pressure of the second portion of the refrigerant; and a compressor configured to compress the refrigerant received from the first low side heat exchanger unit.

2. The refrigeration system of claim 1, wherein the expander comprises an expander wheel that is coupled to a compressor wheel via a shaft;

wherein receiving the second portion of the refrigerant causes the expander wheel to rotate and reduce the pressure of the second portion of the refrigerant received from the first high side heat exchanger in the expander;

wherein the rotation of the expander wheel causes the compressor wheel to rotate via the shaft; and wherein the compressor compress the refrigerant received from the first low side heat exchanger unit.

3. The refrigeration system of claim 1, wherein the compressor of the expansion-compression unit is configured to compress a first portion of the refrigerant received from the low side heat exchanger unit; and wherein the refrigeration system further comprises a first compressor unit positioned downstream of the first low side heat exchanger unit, the first compressor unit comprising one or more compressor configured to compress a second portion of the refrigerant received from the first low side heat exchanger unit.

4. The refrigeration system of claim 1 further comprising:

a second high side heat exchanger positioned downstream of the expansion-compression unit, the second high side heat exchanger configured to cool the refrigerant received from the compressor of the expansion-compression unit.

5. The refrigeration system of claim 4 further comprising:

a flash tank positioned downstream of the expansion-compression unit, wherein the flash tank is configured to receive the refrigerant from the expander and the refrigerant from the second high side heat exchanger; and wherein the flash tank is configured to separate the refrigerant into a liquid refrigerant and a vapor refrigerant.

6. The refrigeration system of claim 5 further comprising:

a second low side heat exchanger unit positioned downstream of the flash tank, the second low side heat exchanger unit comprising a second expansion valve positioned upstream of a second low side heat exchanger;

wherein the second expansion valve is configured to receive a first portion of the liquid refrigerant from the flash tank;

wherein the second low side heat exchanger is configured to cool a second space proximate to the second low side heat exchanger;

a second compressor unit positioned downstream of the second low side heat exchanger unit, the second compressor unit comprising one or more compressor configured to compress the refrigerant received from the second low side heat exchanger unit, and wherein the first high side heat exchanger is positioned downstream of the second compressor unit, the first high side heat exchanger is configured to cool the refrigerant received by the second compressor unit.

7. The refrigeration system of claim 5 further comprising:

a third low side heat exchanger unit positioned downstream of the flash tank, the third low side heat exchanger unit comprising a third expansion valve positioned upstream of a third low side heat exchanger;

wherein the third expansion valve is configured to receive a second portion of the liquid refrigerant from the flash tank;

wherein the third low side heat exchanger is configured to cool a third space proximate to the third low side heat exchanger;

a third compressor unit positioned downstream of the third low side heat exchanger unit, the third compressor unit comprising one or more compressor configured to compress the refrigerant received from the third low side heat exchanger unit; and wherein a second compressor unit is positioned downstream of the third compressor unit, the second compressor unit is configured to compress the refrigerant received from the third compressor unit.

8. The refrigeration system of claim 1 further comprising:

a controllable valve positioned downstream of the first high side heat exchanger and upstream of a flash tank, the controllable valve configured to receive the refrigerant from the first high side heat exchanger, wherein the controllable valve is configured to:

(i) direct a flow of the received refrigerant to the flash tank when the controllable valve is positioned in an open position; and (ii) direct the first portion of the refrigerant to the first low side heat exchanger unit and the second portion of the refrigerant to the expander of the expansion-compression unit when the controllable valve is positioned in a closed position.

9. A method of operating a refrigeration system, the method comprising:

cooling a refrigerant using a first high side heat exchanger;

reducing a pressure of a first portion of the refrigerant received from the first high side heat exchanger using a first expansion valve in a first low side heat exchanger unit;

cooling a first space with the refrigerant received from the first expansion valve using a first low side heat exchanger in the first low side heat exchanger unit;

reducing the pressure of a second portion of the refrigerant received from the high side heat exchange using an expander of an expansion-compression unit; and compressing the refrigerant received from the first low side heat exchanger using a compressor of the expansion-compression unit.

10. The method of claim 9, wherein the expander comprises an expander wheel that is coupled to a compressor wheel via a shaft, wherein receiving the second portion of the refrigerant causes the expander wheel to rotate and reduce the pressure of the second portion of the refrigerant in the expander;

wherein the rotation of the expander wheel causes the compressor wheel to rotate via the shaft; and wherein the compressor compress the refrigerant received from the first low side heat exchanger unit.

11. The method of claim 9 further comprising:

compressing a first portion of the refrigerant received from the first low side heat exchanger unit using the compressor of the expansion-compression unit;

compressing a second portion of the refrigerant received from the first low side heat exchanger in a first compressor unit, the first compressor unit comprising one or more compressor configured to compress the second portion of the refrigerant.

12. The method of claim 9 further comprising:

cooling the refrigerant received from the compressor of the expansion-compression unit using a second high side heat exchanger.

13. The method of claim 12 further comprising:

separating the refrigerant received from the expander of the expansion-compression unit and the refrigerant received from the second high side heat exchanger into a liquid refrigerant and a vapor refrigerant using a flash tank.

14. The method of claim 9 further comprising:

receiving the refrigerant from the first high side heat exchanger in a controllable valve;

directing (i) a flow of the received refrigerant to a flash tank when the controllable valve is in an open position, and (ii) the first portion of the refrigerant to the first low side heat exchanger unit when the controllable valve is in a closed position, and the second portion of the refrigerant to the expander of the expansion-compression unit when the controllable valve is positioned in the closed position.

15. A refrigeration system, comprising:

a first high side heat exchanger configured to receive refrigerant, the first high side heat exchanger configured to cool the refrigerant;

a first low side heat exchanger unit positioned downstream of the first high side heat exchanger, the first low side heat exchanger unit comprising a first expansion valve positioned upstream of a first low side heat exchanger, wherein the first expansion valve is configured to receive a first portion of the refrigerant from the first high side heat exchanger, and wherein the first low side heat exchanger is configured to cool a first space proximate to the first low side heat exchanger; and an expansion-compression unit positioned downstream of the first high side heat exchanger and the first low side heat exchanger unit, the expansion-compression unit comprising:

an expander configured to receive a second portion of the refrigerant from the first high side heat exchanger, wherein the expander is configured to reduce a pressure of the second portion of the refrigerant; and a compressor configured to compress the refrigerant received from the first low side heat exchanger unit;

a flash tank positioned downstream of the expansion-compression unit, wherein the flash tank is configured to receive the refrigerant from the expander of the expansion-compression unit;

a controllable valve positioned downstream of the first high side heat exchanger and upstream of the flash tank;

a controller communicatively coupled to the controllable valve, wherein the controller is configured to:

(i) direct a flow of the refrigerant received to the flash tank when the controllable valve is positioned in an open position; and (ii) direct the first portion of the refrigerant to the first low side heat exchanger unit and the second portion of the refrigerant to the expander of the expansion-compression unit when the controllable valve is positioned in a closed position.

16. The refrigeration system of claim 15, wherein the expander comprises an expander wheel that is coupled to a compressor wheel via a shaft, wherein receiving the second portion of the refrigerant causes the expander wheel to rotate and reduce a pressure of the second portion of the refrigerant received from the first high side heat exchanger in the expander;

wherein the rotation of the expander wheel causes the compressor wheel to rotate via the shaft; and wherein the compressor compress the refrigerant received from the first low side heat exchanger unit.

17. The refrigeration system of claim 15, wherein the compressor of the expansion-compression unit is configured to compress a first portion of the refrigerant received from the first low side heat exchanger unit; and wherein the refrigeration system further comprises a first compressor unit positioned downstream of the first low side heat exchanger unit, the first compressor unit comprising one or more compressor configured to compress a second portion of the refrigerant received from the first low side heat exchanger unit.

18. The refrigeration system of claim 15 further comprising:

a second high side heat exchanger positioned downstream of the expansion-compression unit, the second high side heat exchanger configured to cool the refrigerant received from the compressor of the expansion-compression unit.

19. The refrigeration system of claim 18, wherein the flash tank is configured to receive the refrigerant from the second high side heat exchanger; and wherein the flash tank is configured to separate the refrigerant into a liquid refrigerant and a vapor refrigerant.

20. The refrigeration system of claim 15 further comprising:

a second low side heat exchanger unit positioned downstream of the flash tank, the second low side heat exchanger unit comprising a second expansion valve positioned upstream of a second low side heat exchanger;

wherein the second expansion valve is configured to receive the refrigerant from the flash tank;

wherein the second low side heat exchanger is configured to cool a second space proximate to the second low side heat exchanger;

a second compressor unit positioned downstream of the second low side heat exchanger unit, the second compressor unit comprising one or more compressor configured to compress the refrigerant received from the second low side heat exchanger unit; and wherein the first high side heat exchanger is positioned downstream of the second compressor unit, the first high side heat exchanger is configured to cool the refrigerant received by the second compressor unit.

* * * * *